US007509928B2

(12) United States Patent
Becker et al.

(10) Patent No.: US 7,509,928 B2
(45) Date of Patent: Mar. 31, 2009

(54) SUSPENDED STEAM BOILER

(75) Inventors: Martin Becker, Leverkusen-Schlebusch (DE); Vu-Tam Lai, Wesel (DE)

(73) Assignee: Hitachi Power Europe GmbH, Oberhausen (DE)

( * ) Notice: Subject to any disclaimer, the term of this patent is extended or adjusted under 35 U.S.C. 154(b) by 111 days.

(21) Appl. No.: 11/701,344

(22) Filed: Feb. 1, 2007

(65) Prior Publication Data

US 2007/0175413 A1 Aug. 2, 2007

(30) Foreign Application Priority Data

Feb. 2, 2006 (DE) ..... 10 2006 005 208

(51) Int. Cl.
*F22B 37/10* (2006.01)

(52) U.S. Cl. ..... 122/450; 122/235.12; 122/511

(58) Field of Classification Search ..... 122/450, 122/1 B, 406.4, 460, 265, 235.12, 493, 510, 122/511
See application file for complete search history.

(56) References Cited

U.S. PATENT DOCUMENTS

| | | | | | |
|---|---|---|---|---|---|
| 3,298,360 | A * | 1/1967 | Michel | 122/510 |
| 3,307,524 | A | 3/1967 | Ambrose | |
| 4,075,979 | A * | 2/1978 | Michel | 122/235.12 |
| 4,178,881 | A * | 12/1979 | Pratt et al. | 122/235.12 |
| 4,245,588 | A * | 1/1981 | Gill et al. | 122/6 A |
| 4,987,862 | A * | 1/1991 | Wittchow et al. | 122/6 A |
| 5,203,285 | A * | 4/1993 | Tsukino et al. | 122/6 A |
| 5,390,631 | A * | 2/1995 | Albrecht | 122/235.12 |
| 5,722,353 | A * | 3/1998 | Phelps | 122/6 A |
| 5,934,227 | A * | 8/1999 | Phelps | 122/6 A |
| 2006/0213457 | A1 * | 9/2006 | Upton | 122/406.4 |

FOREIGN PATENT DOCUMENTS

| | | |
|---|---|---|
| DE | 1 193 964 | 4/1960 |
| DE | 1 551 015 | 3/1970 |
| DE | 2 316 135 A | 10/1974 |
| DE | 26 21 189 B | 11/1977 |
| EP | 0 187 542 | 7/1986 |
| GB | 1 192 992 | 9/1967 |

* cited by examiner

*Primary Examiner*—Gregory A Wilson
(74) *Attorney, Agent, or Firm*—Collard & Roe, P.C.

(57) ABSTRACT

Suspended steam boiler, in which the steam boiler lower portion (5), having inclined tubes, is suspended from the steam boiler upper portion (1), having vertical tubes exclusively from the vertical tubes of the latter without additional external tensile or support elements. (FIG.1)

5 Claims, 3 Drawing Sheets

SUSPENDED STEAM BOILER

CROSS REFERENCE TO RELATED APPLICATIONS

Applicants claim priority under 35 U.S.C. §119 of German Application No. 10 2006 005 208.0 filed Feb. 2, 2006.

BACKGROUND OF THE INVENTION

1. Field of the Invention

The invention relates to a suspended steam boiler including a steam boiler upper part, comprising a vertical tube wall, composed of vertical tubes and vertical web formed there between and a steam lower portion suspended from the vertical tube wall including an inclined tube wall composed of inclined tubes and inclined webs formed there between.

2. Description of the Related Art

The walls of larger sized steam boilers operating according to the forced once-through principle or forced circulation principle are nowadays designed as diaphragm tube walls composed of tube and web constructions. In order for the boilers to be able to expand freely, they are suspended in a boiler scaffolding. For that purpose, the boiler scaffolding includes a boiler scaffolding top, in which the supporting cables of the steam boiler are suspended. Accordingly, the entire weight of the steam boiler is absorbed by the boiler scaffolding top.

The steam boiler, in turn, must be so designed that the total weight comprising its own weight, the water content, ashes and the like, can be taken up by the boiler scaffolding top. The steam boiler upper portion includes membrane tube walls wherein the tubes are vertically disposed, and through which the medium flows in vertical direction (here denoted as vertical tube wall). On the other hand, in the steam boiler lower portion, the combustion chamber is surrounded by membrane tube walls which are not vertical but which rise at an incline to the horizontal (here denoted as inclined tube wall).

The load absorption takes place in the vertical tube wall of the steam boiler along the longitudinal axis of the vertical tubes, so that these are placed under tensile load in the direction of the tube axes.

On the other hand, in the lower portion of the steam boiler the load absorption takes place in the inclined tube wall at low angles of inclination transversely to the longitudinal axis of the inclined tubes. Accordingly, in this case, part of the loads arising is transferred to the tube cross section which, by comparison with the tube axis, is weaker.

In order to relieve these tube cross sections of loads it is, for example, known from DE 26 21 189 B to support the steam boiler lower portion on additional external tensile or load bearing elements which are anchored to the steam boiler upper portion. The tensile element extends more particularly in the form of tensile straps over the entire height of the inclined tube wall to which they are connected by way of filler members, welding-on blocks or clamping means, and terminate slightly above the inclined tube wall on the vertical tube wall to which they are welded by way of tensile strap heads, moulded members, welding-in panels, metal sheets, lugs or other connecting members. Accordingly, the load is transferred by the tensile or support elements from the steam boiler lower portion including the inclined tube wall into the vertical tube wall of the steam boiler upper portion.

With such external tensile elements which are welded by way of connecting members to the inclined tube wall, it is necessary, however, to ensure a good heat transfer from the tube walls to the tensile elements. In spite of this, load fluctuations occur, in particular in the inclined tube wall during each load change of the steam boiler resulting from a delayed following-up by the tensile element as against the membrane tube wall. Moreover, the application of the numerous connections of the tensile elements to the inclined tube wall involves an appreciable construction and welding expenditure. According to a further proposal known from DE 23 16 135 A the steam boiler lower portion which is directly welded to the vertical tubing of the steam boiler upper portion is, therefore, supported while its tube plate by way of linkage supports on support elements in the form of beams which are in their turn suspended by way of tensile anchors from the vertical tube wall of the steam boiler upper portion. However, this known proposal itself involves a substantial constructional expenditure combined with an increased weight due to the support element which must be absorbed by the vertical tube wall.

SUMMARY OF THE INVENTION

As a result of the invention the constructional expenditure for the suspension of the lower portion of the steam boiler is reduced substantially.

The subject of the invention is a suspended steam boiler including a steam boiler upper portion having a vertical tube wall composed of vertical tubes with vertical webs formed there between and a steam boiler lower portion suspended from the vertical tube wall including an inclined tube wall composed of inclined tubes and inclined webs formed there between. Along the upper edge of the inclined tube wall at which the upper terminal regions of the inclined tubes terminate in mutually staggered relationship in the horizontal direction, a coupling strip is formed including a plurality of vertical tube bends and a plurality of inclined tube bends. The vertical tube bends and the inclined tube bends each comprise a connecting limb projecting, preferably normal to, in outward direction from the coupling strip. The second leg of each vertical tube bend is a vertical limb, moulded into the coupling strip. The second limb of each inclined tube bend is an inclined limb which, likewise, is moulded into the coupling strip. The vertical limb of each of the vertical tube bends is vertically aligned with a vertical tube of the vertical tube wall provided there above and is welded thereto. The inclined limb of each of the inclined tube bends is aligned with one of the terminal regions of the inclined tubes of the inclined tube wall and is welded thereto. The coupling strip, in turn, is welded below the inclined limbs of the inclined tube bends along the inclined limbs to the respectively adjoining inclined web or the inclined tube terminal region there below of the respectively adjoining inclined tube and above the upper terminal sections of the inclined tubes along the terminal sections to the inclined webs or to the upper terminal sections of the inclined tubes. In addition, the suspension of the lower portion of the steam boiler from the vertical tube wall is brought about exclusively by welding of the coupling strip to the inclined tube wall and by way of welding the vertical limbs of the vertical tube bends of the coupling strip to the vertical tubes of the vertical tube wall, without the steam boiler lower portion being supported on or suspended from additional external tensile- or support elements which are suspended from the vertical tube wall.

Outside of the vertical limbs of the vertical tube bends, a thermal expansion joint is formed between the coupling strip and the vertical webs of the vertical tube wall. Between the steam boiler upper portion and the steam boiler lower portion an external manifold system is formed which is connected to the respective connecting limbs of the vertical tube bends and the inclined tube bends. Due to the incorporation of the vertical limbs of the vertical tube bends and the inclined limbs of the inclined tube bends into the coupling strip by which the inclined tube wall is connected at the transition to the vertical tube walls, the manifold system is completely relieved of the weight of the steam boiler lower portion.

In addition, the weight of the steam boiler lower portion is absorbed uniformly by the coupling strip along the upper end each of the inclined tube walls without loading peaks arising along the upper terminal regions of the inclined tubes, because the inclined limbs of the inclined tube connecting bends welded to the terminal regions of the inclined tubes are incorporated in the coupling strip and the loading is also uniformly distributed in the coupling strip by means of the inclined webs of the inclined tube wall and is transmitted into the vertical tubes of the vertical tube wall by the coupling strip by way of the vertical limbs of the vertical connecting tube bends in uniform distribution.

Due to the omission of additional tensile and support elements, by which, according to the state of the art, the weight of the steam boiler lower portion is transmitted in addition to the load transfer along the vertical tubes into the vertical tube wall, an appreciable reduction of the overall weight of the steam boiler is attained because all such tensile and support elements including the welding-on members required for fastening to the inclined tube wall and the vertical tube wall, are dispensed with. Without separate tensile and support elements, moreover, the assembly of the complete inclined tube region of the steam boiler is simple and can be performed solely with minor welding expenditure, and damage to the inclined tube wall due to uneven heating in the region of the burner chamber, is dispensed with. In addition, the fluctuating loading of the membrane tube wall is eliminated which, otherwise, would occur with each loading change of the steam boiler from the lagging behind of the tensile and support elements in relation to the inclined tube wall, and there exists substantial freedom as regards the speed with which load changes are permissible during starting up and closing down the steam boiler.

In-house optimising calculations, for example simulations and model calculations according to the finite elements method have revealed that, by means of the basic construction of the steam boiler according to the invention by targeted variation of the diameter and wall thickness of the inclined tubes and their spacing along the inclined tube wall as well as wall thickness and width of the inclined webs of the inclined tube wall, a self-supporting construction thereof is attained. By the intervention of the manifold system between the vertical tubes of the steam boiler upper portion and the inclined tubes of the steam boiler lower portion, there exists substantial freedom of selecting the number and diameters of the inclined tubes as compared with those of the vertical tubes of the vertical tube wall. The angle of inclination as well of the inclined tubes can be selected substantially at will.

The advantages of the invention arising from the omission of additional external tensile and supporting elements apply in particular to single duct or multiple duct steam boilers operated in once-through or forced circulation mode with spiral tube combustion chamber up to a construction height of 200 m and a combustion chamber cross-section of up to 30 m×30 m where the angles of inclination of the inclined tubes are substantially optional and for all conventional tube dimensions of the steam boiler tubing as well as for the use of a variety of fuels, such as oil, gas, black coal and brown coal.

With steam boilers according to the invention, the number of vertical tubes of the vertical tube wall may, in particular, be larger than the number of inclined tubes of the inclined tube wall so that the coupling strip and accordingly the inclined tube wall are suspended from the vertical tube wall by means of groups of a plurality of vertical tube bends per inclined tube, whereby the load transfer of the inclined tube wall to the vertical tube wall is distributed over a plurality of vertical tubes per inclined tubes.

Preferably, the coupling strip is assembled from a plurality of welded together coupling form plates of which each, preferably forged, form plate comprises at least one and preferably one of the groups of the plurality of vertical tube bends and a single inclined tube bend per group. However, it is also possible to provide form plates comprising several groups of vertical tube bends and inclined tube bends, which may also alternate with such form plates having only one such group or which may, in particular, at the corners of the inclined tube wall be so combined. In particular, the form plates may comprise two to five vertical tube bends per groups which may also be combined with one another.

If a plurality of vertical tube bends per inclined tube bend is provided, it is furthermore preferred that the connecting limb of the inclined tube bend and the connecting limb of one of the vertical tube bends along the one side edge of the outer periphery of the form plate are arranged one above the other, and that the length of the vertical limb of the remaining vertical tube bends of the group increases in size as the distance of the one side edge increases, so that the connecting limbs of the group are arranged in a row which is parallel to the inclined limb of the inclined tube bend.

DETAILED DESCRIPTION OF PREFERRED EMBODIMENTS

Figure 1:
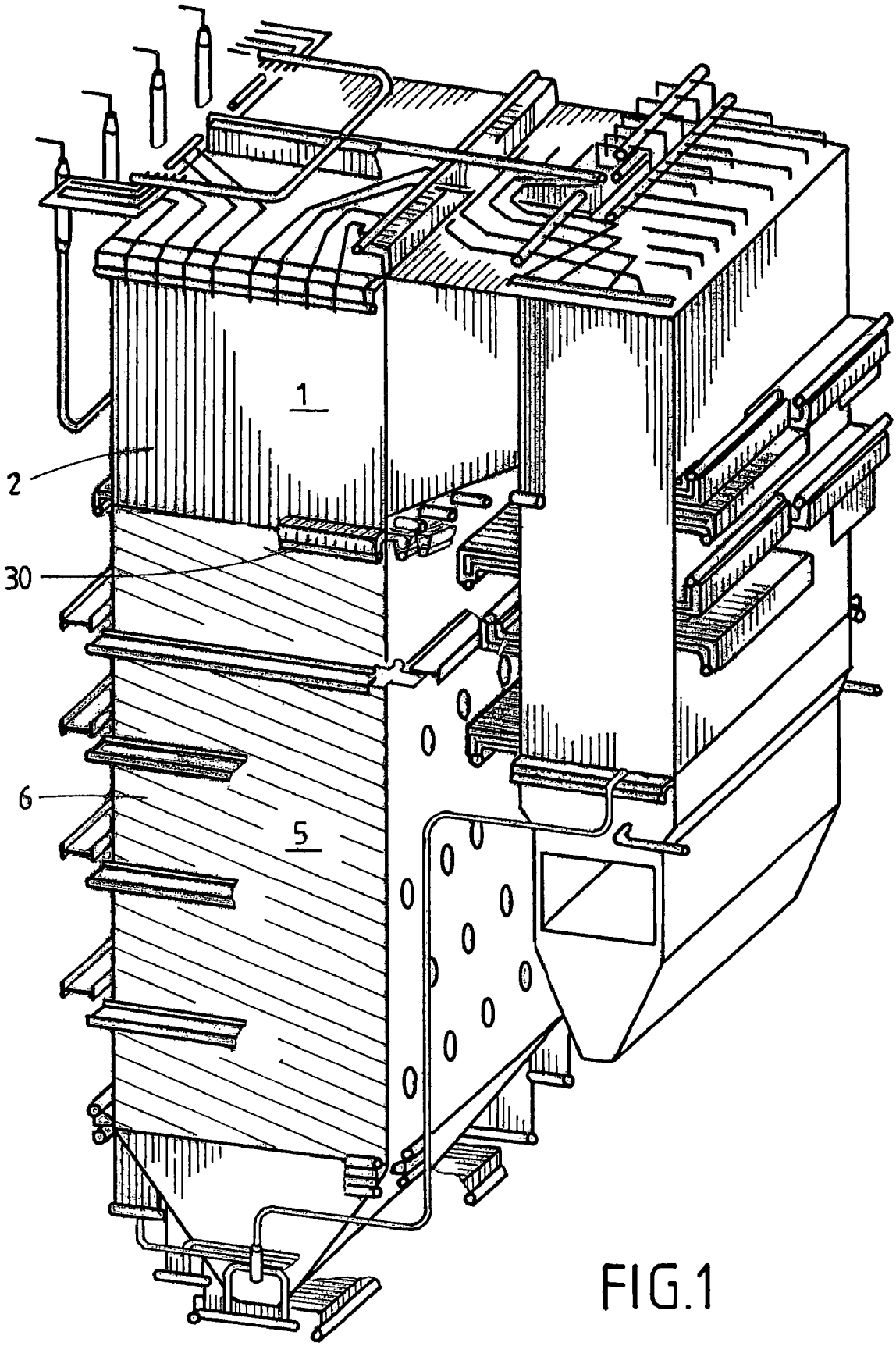
FIG. 1 of the drawings represents a steam boiler according to the invention in diagrammatic perspective view.

The suspended steam boiler of FIG. 1 includes a steam boiler upper portion 1 which is surrounded by a vertical tube wall 2 and a steam boiler lower portion 5 which is surrounded by an inclined tube wall 6 and is suspended from the vertical tube wall 2 of the steam boiler upper portion 1 without external tensile and/or support elements.

Figure 2:
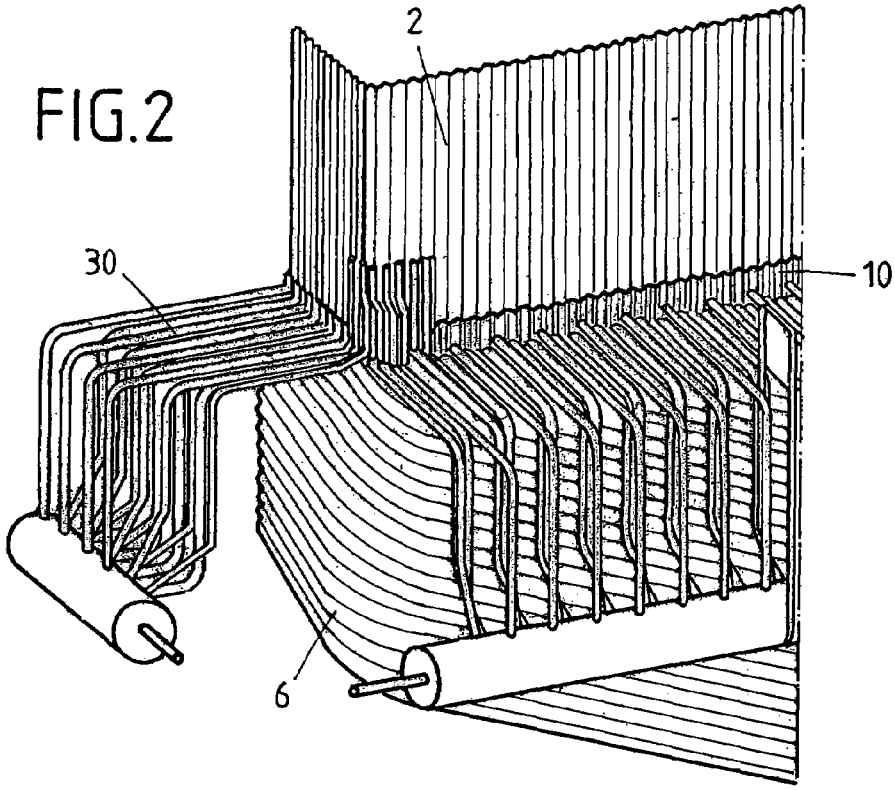
FIG. 2 shows a detail of the steam boiler at the transition between the vertical tube wall (2) of the steam boiler upper portion (1) and the inclined tube wall (6) of the steam boiler lower portion (5), including an interconnected manifold system (3)
Figure 3:
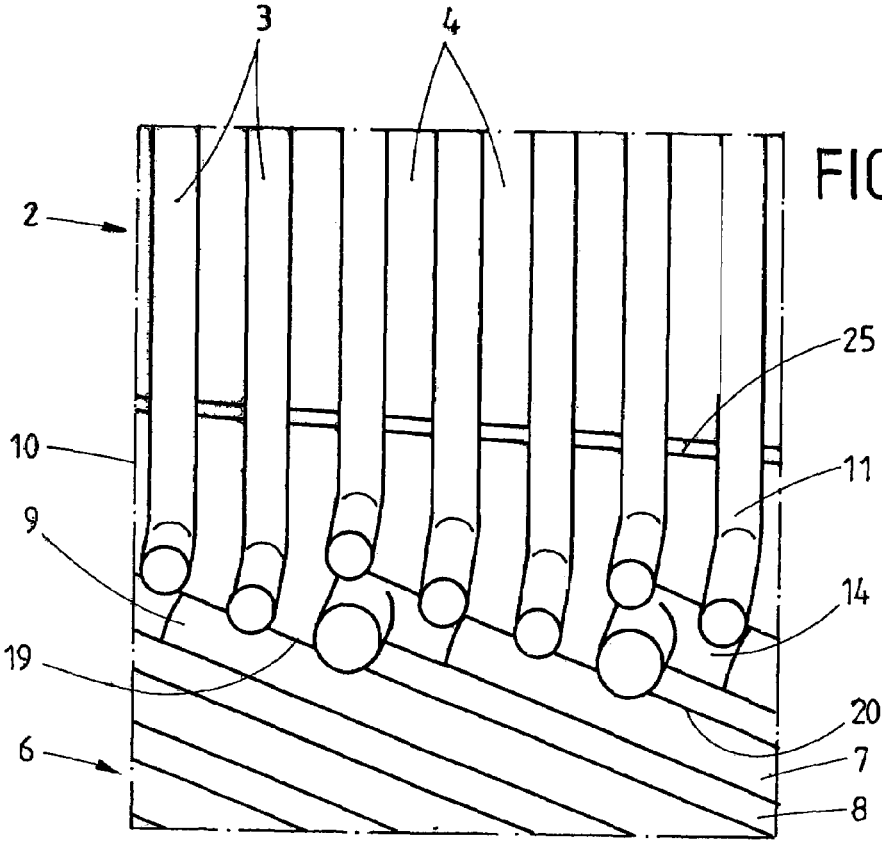
FIG. 3 represents a detail of FIG. 2 at the level of the coupling strip 10 but without the manifold system.

For that purpose, as is apparent from FIGS. 2 and 3, a coupling strip 10 is provided assembled from forged form plates 16 (FIG. 4) welded to one another, and which, in its turn, is welded to the inclined tube wall 6 and into which vertical tube bends 11 are incorporated which, in their turn, are welded to the vertical pipes 3 of the vertical tube wall 2. Outside of the vertical tube bends 11, an expansion joint 25 is formed between the coupling strip 10 and the vertical tube wall 2, so that the weight of the steam boiler lower portion is absorbed exclusively by the vertical pipes 3 of the steam boiler upper portion.

Both the vertical tube wall 2 as well as the inclined tube wall 6 is formed as a membrane wall from a tube and web construction. Thus, the vertical tube wall 2 comprises a plurality of vertical tubes 3 with intervening vertical webs 4, whereas the inclined tube wall 6 comprises a plurality of inclined tubes 7 with intervening inclined webs 8. The upper terminal regions 9 of the inclined tubes 7 accordingly terminate along the upper edge of the inclined tube wall 6, mutually staggered in relation to one another in the horizontal direction.

Along this upper terminal region 9 of the inclined tubes 7, the inclined webs 8 or the inclined tube wall 6 are cut away (FIG. 3). Correspondingly, the coupling strip 10 along its lower edge is cut away at an angle for each of the vertically upwardly exposed terminal regions 9 of the inclined tubes 7 as apparent from FIG. 4 for one of the forged coupling form plates 16, so that the coupling form plates 16 are provided with a welding edge 19 extending at an incline in accordance with the inclined tube bend and along which the coupling strip 10 is welded in each case above the respective terminal region 9 of the inclined tube 7 along the latter to the inclined tube wall 6.

Figure 4:
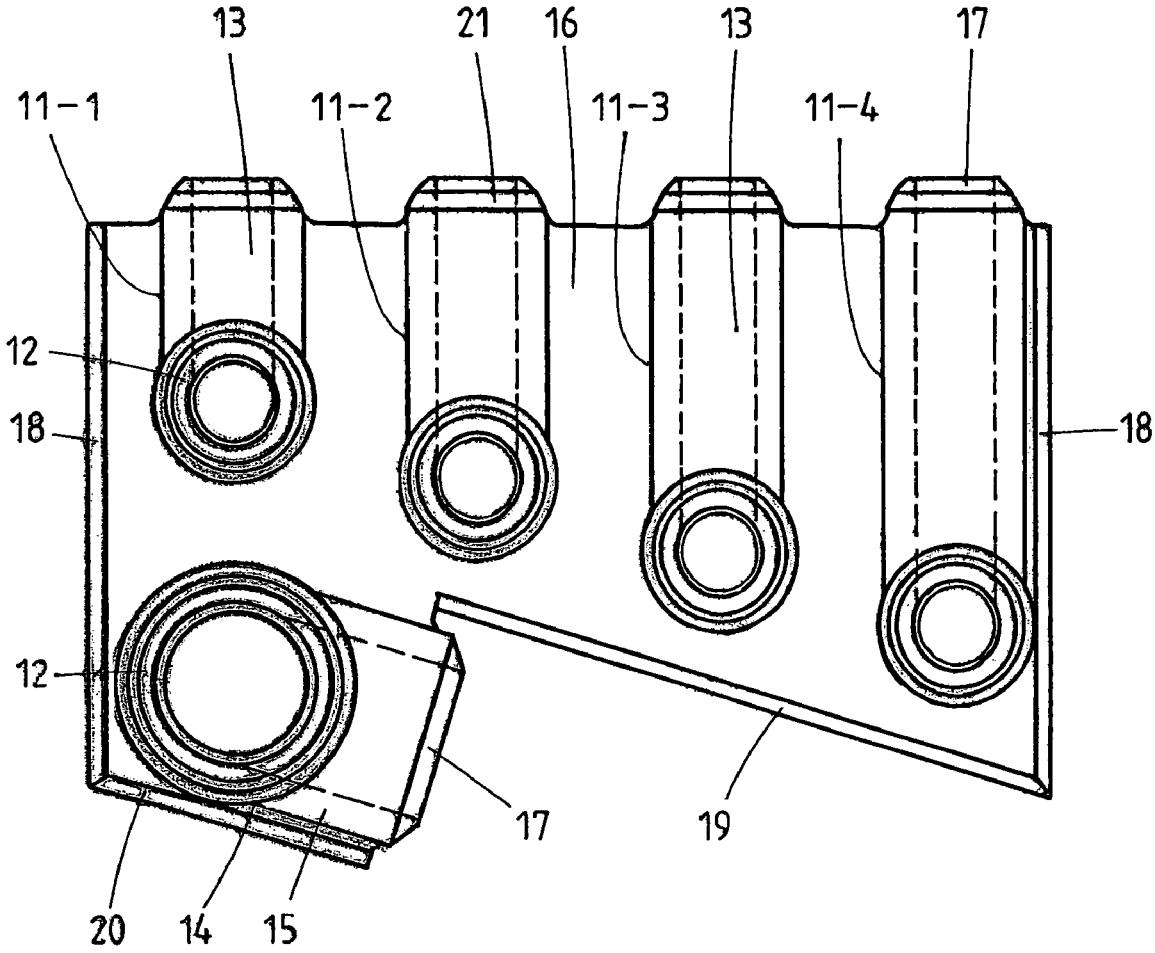
FIG. 4 represents a working example of one of the welded coupling form plates 18, of which the coupling strip 10 according to FIG. 3 is assembled.

As is furthermore apparent from FIGS. 3 and 4, a plurality of vertical tube bends 11, corresponding to the plurality of vertical tube 3 of the vertical tube wall 2, are fitted into the coupling strip 10 assembled from the form plate 16 along their vertical limbs 13, as well as a plurality of the inclined tubes 7 corresponding to the plurality of inclined tube bends 14 of the inclined tube wall 6 along their inclined limbs 15. The vertical limbs 13 of the vertical tube bends 11 project with a welding bead 21 above the upper edge of the form plate 16 and are welded along the latter to the respective vertical tube 3. The inclined limbs 15 of the inclined tube bends likewise project beyond the respective lateral edge of the form plate 16 by means of a welding bead 17 and are welded at the latter to the respective terminal region 9 of the inclined tubes 7.

The form plates 16 of the coupling strip 10 include below each inclined web 15 a welding bead 20, inclined like the former, along which the coupling strip is likewise welded to the respective inclined web 8 of the inclined tube wall 6 forming an extension of the welding bead 19 of the respectively adjoining form plate 16. The form plates 18 moreover include vertical welding beads 18 along both of their vertical side edges, along which they are welded to the respectively adjoining form plates of the coupling strip 10 in such a manner that the inclined welding bead 19 of the one form plate is aligned with the inclined welding bead 20 of the adjoining form plate as an extension thereof.

As may best be seen from FIG. 4, along each form plate 16 a group of a plurality of vertical tube bends 11 and an inclined tube bend 15 are formed in such a manner that the connecting limb 12 of the inclined tube bend and one of the vertical tube bends 11-1 are arranged vertically above one another along the side edge of the form plate which, in FIG. 4, is on the left hand side, and the connecting limbs 12 of the vertical tube bend 11-1 to 11-4 are arranged in a row which extends parallel to the axis of the inclined limb 15 of the inclined tube bend 14 and, accordingly, of the upper terminal portion 9 (FIG. 3) of the inclined tube welded to the inclined limb. The vertical limbs 11-1 to 11-4 have a length which progressively increases from the vertical tube bend 11-1 to the vertical tube bend 11-4 in accordance with the incline of the row.

With the construction according to the invention of the suspended steam boiler, particularly the dimensions of the membrane tube walls in the steam boiler upper portion and in the steam boiler lower portion and their materials of manufacture are so selected by targeted optimisation calculations that the inclined tube wall of the lower portion is suspended self-supportingly solely from the vertical tubes of the vertical tube wall and, accordingly, without assistance from external tensile and/or support elements. By way of example, the following dimensioning was selected:

EXAMPLE

Steam Boiler Upper Portion:

Vertical tubes having an outer diameter Da=38 mm and a wall thickness not less than 5 mm, spacing of the vertical tubes not less than 58 mm, web thickness of the vertical webs s=6 or 8 mm respectively. Depending on the thermal load in the combustion chamber, internal pressure and weight, the wall thickness of the tube may be, for example, 5,6 mm, 6,3 mm or 7,1 mm.

Steam Boiler Lower Portion:

Inclined tubes having an outer diameter Da=42,4 or 44,5 respectively and a wall thickness not less than 5,6 mm, spacing of the inclined tubes not less than 58 mm, web thickness of the inclined webs s=6 or 8 mm respectively. Depending on the thermal load in the combustion chamber, the internal pressure and the weight, the wall thickness may, for example, be 5,6 mm, 6,3 mm or 7,1 mm.

The material of manufacture according to EN 10216, DIN or VDTÜV-material sheet of the inclined tube wall, depending on thermal load in the combustion chamber, internal pressure and weight, consists, for example, of:

1.5415 (16Mo3)
1.7335 (13CrMo 4-5)
1.7380 (10 CrMo 9-10)
1.7378 CrMoVTiB10-10 (T24)

The angle of inclination of the inclines tubes can be optional.

The invention claimed is:

1. A suspended steam boiler including a steam boiler upper portion (1), having a vertical tube wall (2) composed of vertical tubes (3) with vertical webs (4) formed there between and a steam boiler lower portion (5) suspended from the vertical tube wall including an inclined tube wall (6) composed of inclined tubes (7) and inclined webs (8) formed there between, the inclined tubes having upper terminal regions (9), terminating in horizontally mutually staggered relationship at the upper edge of the inclined tube wall and a coupling strip (10) being formed along the upper edge of the inclined tube wall, having a plurality of vertical tube bends (11) including connecting limbs (12) projecting from the coupling strip and vertical limbs (13) formed into the coupling strip, and being welded to the vertical tubes (3), and having a plurality of inclined tube bends (14) having connecting limbs (12) projecting from the coupling strip and inclined limbs (15) formed into the coupling strip, welded to the terminal regions (9) of the inclined tubes, the coupling strip (10) being welded to the inclined tube wall (6) below the inclined limbs of the inclined tube bends along the inclined limbs (15) and above the terminal regions of the inclined tubes along the terminal regions (9) and the suspension of the steam boiler lower portion (5) from the vertical tube wall (2) is brought about by welding of the coupling strip (10) to the inclined tube wall and by the welding of the vertical limbs (13) of the vertical tube bends of the coupling strip to the vertical tubes (3) of the vertical tube wall, without the steam boiler lower portion being supported on or from additional external tensile or support elements.

2. Steam boiler according to claim 1, wherein the number of vertical tubes of the vertical wall exceeds the number of inclined tubes (7) of the inclined tube wall (6), such that the coupling strip (10) and accordingly also the inclined tube wall is suspended from the vertical wall by groups of pluralities of vertical tube bends (11-1 to 11-4) per inclined tube (7).

3. Steam boiler according to claim 2, wherein the coupling strip is assembled from a plurality of coupling form plates (16) welded together, of which each includes at least one of the groups of a plurality vertical tube bends (11-1 to 11-4) and one inclined tube bend (14) per group.

4. Steam boiler according to claim 3, wherein the form plates (16) comprise two or five vertical tube bends (11) per group.

5. Steam boiler according to claim 3, wherein the connecting limb (12) of the inclined tube bend (14) and the connecting limb (12) of one of the vertical tube bends (11-1) are arranged above one another along the one side edge of the periphery of the form plate (16) and the length of the vertical limbs (13) of the remaining vertical tube bends (11-2 to 11-4) of the group progressively increases as the distance from the one side edge increases, such that the connecting limbs (12) of the group are arranged in a row parallel to the inclined limb (15) of the inclined tube bend.

* * * * *